US005282535A

United States Patent [19]

Rowland

[11] Patent Number: 5,282,535

[45] Date of Patent: Feb. 1, 1994

[54] SKI CARRIER

[76] Inventor: Anthony Rowland, 1322 Centinela Ave., #6, Los Angeles, Calif. 90025

[21] Appl. No.: 993,418

[22] Filed: Dec. 21, 1992

[51] Int. Cl.[5] ..... B65D 85/20; A63C 11/00

[52] U.S. Cl. ..... 206/315.1; 280/814

[58] Field of Search ..... 206/315.1; 280/814

[56] References Cited

U.S. PATENT DOCUMENTS

| | | | |
|---|---|---|---|
| 2,042,086 | 5/1936 | Aubert | 280/814 |
| 3,767,036 | 10/1973 | McLeod | 206/315.1 |
| 4,161,268 | 7/1979 | Heil | 206/315.1 |
| 4,238,063 | 12/1980 | O'Dair | 206/315.1 |
| 4,643,302 | 2/1987 | Baumgardner | 206/315.1 |
| 5,160,075 | 11/1992 | Moscovitch | 206/315.1 |

FOREIGN PATENT DOCUMENTS 116141 1/1982 Canada ..... 206/315.1

OTHER PUBLICATIONS

Kis Skitube USA, Adv. Brochure P.O. Box 502, Avon, Colo. 81620–date unknown.

*Primary Examiner*—William I. Price

[57] ABSTRACT

A ski carrier comprising a pair of spaced, parallel resilient plates that receive therebetween a pair of skis with the surfaces of the skis lying substantially perpendicular to the planes of the, the plates having retaining means at their respective ends for accepting the edges of a pair or a plurality of skis, and a container for skis so mounted are disclosed.

24 Claims, 3 Drawing Sheets

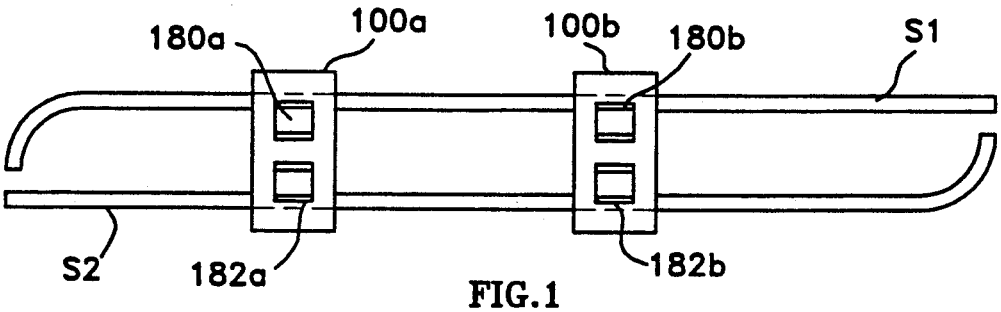
FIG.1
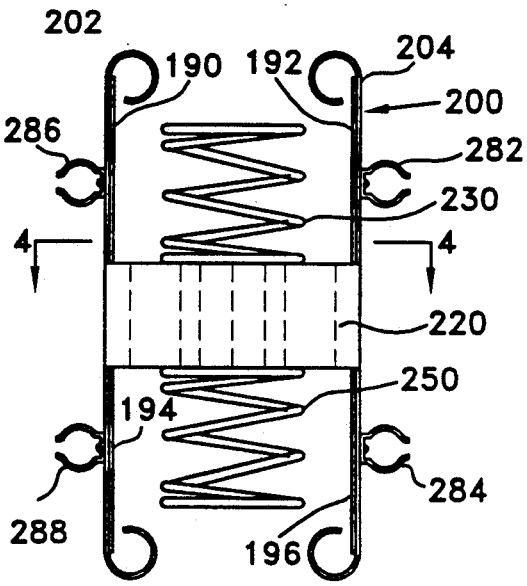
FIG.3
FIG.2
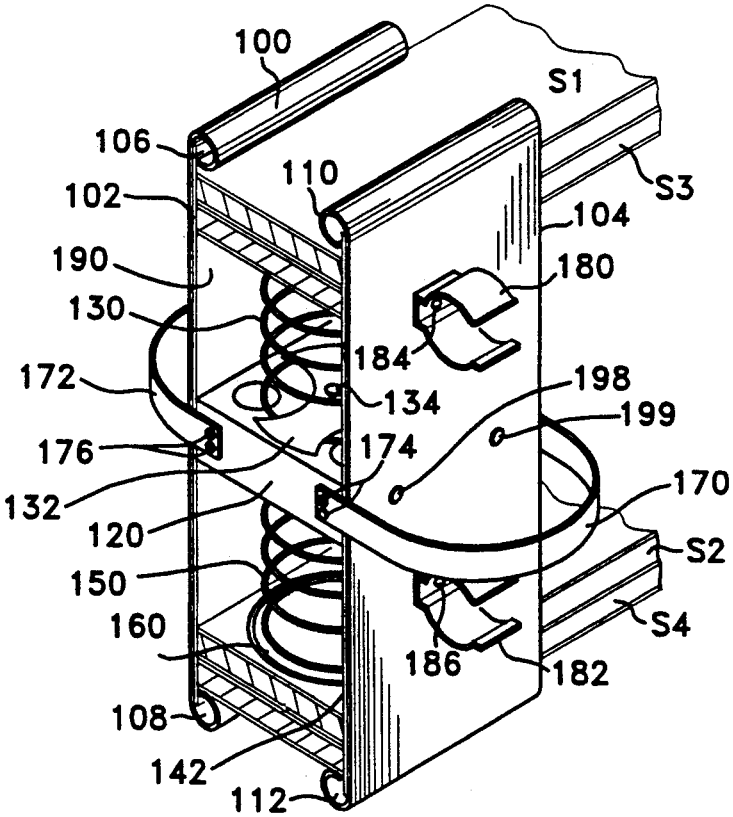

FIG.8
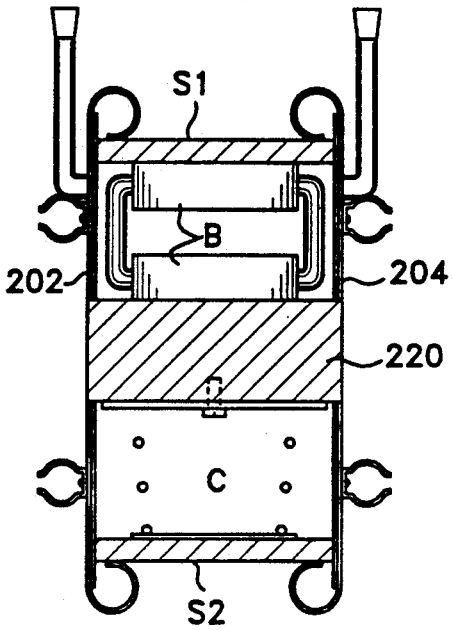
FIG.10
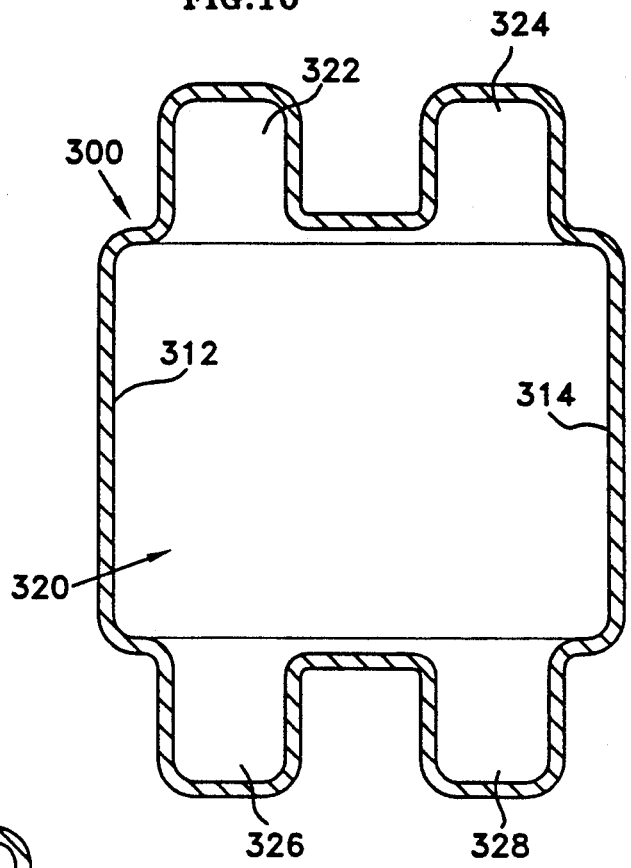
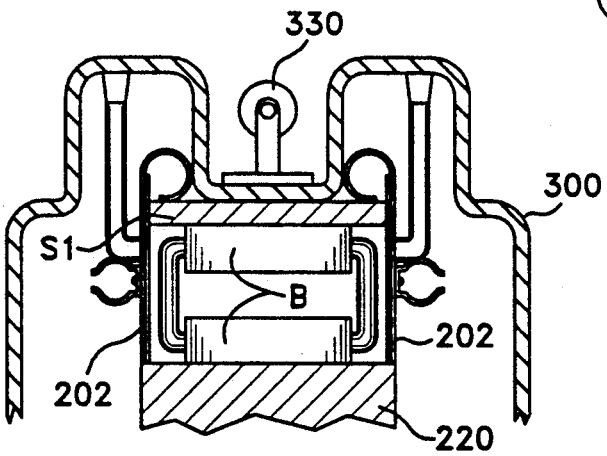
FIG.11
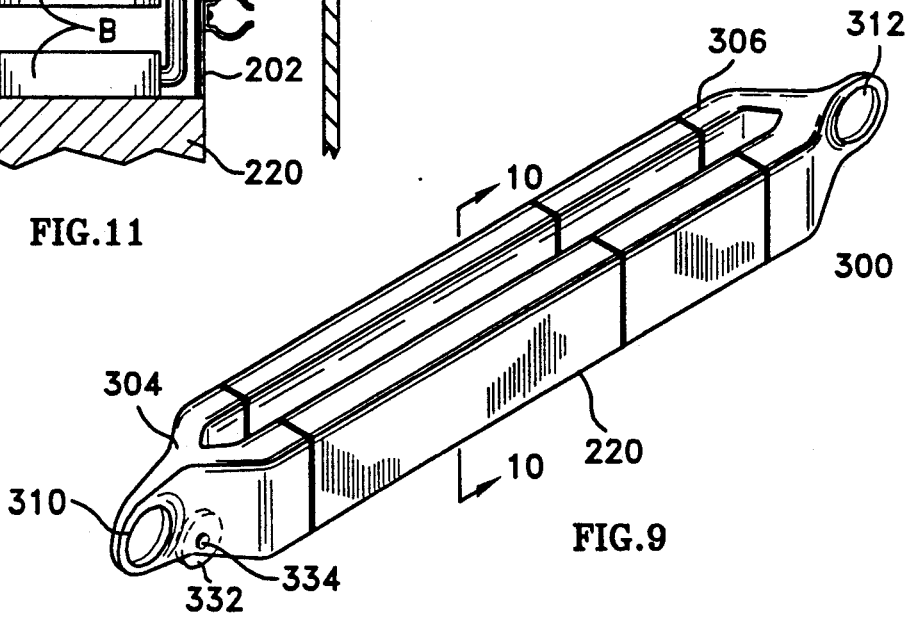
FIG.9

SKI CARRIER

FIELD OF THE INVENTION

This invention relates to snow skis, primarily but may be applicable to other kinds of skis, and, more specifically relates to a mechanism for carrying snow skis and the like. In the specification, the term "skis" or "ski" will be used with the understanding that the principal reference of this application is to snow skis but it is not necessarily limited to snow skis.

BACKGROUND OF THE INVENTION

Skis are among the most difficult and inconvenient articles that are commonly carried or shipped. Even storage of skis presents inconveniences because they are very long, much longer than ordinary storage and shipping spaces. Added to this inconvenience is the importance of protecting the skis from abrasion, scratching and other damages while being shipped or stored. For shipment on airlines, skis are commonly tied or clamped together and put in a plastic or fiber bag. This protects, in some measure, other baggage from damage by the skis but does little to protect the skis. The bags are prone to tear and are inadequate to provide full protection for the skis. They are also difficult to handle because they tend to catch on locks, handles and mechanisms of nearby baggage.

Skis are frequently carried on the top or rear of vehicles. Skis are clamped on the vehicle and, while clamped, are relatively safe from damage, but are still subject to weathering and theft.

A great many types of ski clamps have been devised for carrying skis in various configurations and arrangements. None of these are, to the applicants knowledge, entirely satisfactory and few of them are even suitable for protecting skis while shipping them especially during shipment on airlines.

It is an object of this invention to provide an improved ski clamp and a container for storing and shipping skis. Many other objects will be apparent by consideration of the specification and the drawings.

BRIEF SUMMARY OF THE INVENTION

Briefly, the present invention comprises a pair of resilient leaf springs secured in parallel spaced apart relationship configured to clamp skis between the leaf springs and comprising various means for assuring that the skis are clamped, carrying poles and other mechanisms. The invention, in a larger sense also comprises a carrier box specifically adapted to carry skis and the clamp described.

In a preferred embodiment, the invention includes a carrier for skis of the type that comprise an elongate flat beam structure forming upper and lower surfaces lying, respectively, in generally parallel plane, e.g. typical alpine or cross-country skies, water skies, etc. Alpine snow skis are more frequently transported by air and common carrier and, therefore, this invention will find greatest applicability with such skis.

The carrier comprises a pair of generally planar spring plates each plate having first and second ends. Ski retaining means extend from the plates toward each other at said first and second ends of the plates. A spacer secured generally centrally to the plates mounts the spring plates in spaced parallel relationship, the respective ski retaining means extending toward each other from the respective spring plates. The plates, spacer means and retaining means are dimensioned and configured to permit a first ski to be retained snugly between the respective first ends of the plates and a second ski to be retained snugly between the respective second ends of the plates with the plane of surfaces of the skis lying generally perpendicularly to the planes of the plates. The structure, including the resiliency of the spring plates, permits the skis to be inserted into such retained position and removed therefrom by spreading the respecrive ends of the plates apart against resilient retaining forces exerted by the plates.

Polymeric protective sheets on the facing surfaces of the spring plates prevent abrasion of the skis by the spring plates.

Means resiliently forcing the first and second skis, respectively, against the respective retaining means at the respective first and second ends of the plates retain the skis adjacent the ends of the plates in parallel relationship to each other. The retaining means may comprise inwardly rolled portions of the material of which the spring plates are formed. The resilient means forcing the skis toward the ends of the plates preferably comprises a coil spring secured to the spacer means and extending between and toward the respective ends of the of the plates. Pressure pads secured at the distal ends of the coil springs exert a resilient pressure on the respective skis without abrading the skis.

A resilient shock absorbing means extends outwardly from the spacer block on both sides thereof substantially perpendicular to the planes of the respective plates. The resilient shock absorbing means may comprise a pair of resilient bands and means securing the respective ends of the respective bands to the spacer means.

The ski carrier may further comprise one or more clips for resiliently securing a ski pole to the carrier.

In a basic form, the ski carrier comprises a pair of generally planar spring plates each plate having first and second ends, ski retainers formed at the respective ends of the respective plates from the material of which the plates are formed extending in the same direction from the plane of the respective plate, a spacer block, means securing the spacer block generally centrally to the plates mounting the spring plates in spaced parallel relationship with the respective ski retainers extending toward each other from the respective spring plates. The plates, spacer and retainers are so dimensioned and configured as to permit a first ski to be retained snugly between the respective first ends of the plates and a second ski to be retained snugly between the respective second ends of the plates with the surfaces of the skis generally perpendicularly to the planes of the plates and to permit the skis to be inserted into such retained position and removed therefrom by spreading the respective ends of the plates apart against resilient retaining forces exerted by the plates.

In another basic form the ski carrier comprises a pair of generally planar resilient plates secured in spaced apart parallel planar relationship to receive therebetween a pair of skis with the plane surfaces of the skis lying substantially perpendicular to the planes in which the plates lie, the plates having first and second ends, retainers on the first ends of the respective plates extending toward each other, retainers on the second ends extending toward each other, the plates and retainers being so configured and constructed as to accept between the plates adjacent the retainers a first ski between the first ends and a second ski between the second ends.

In another facet, the invention comprises a ski container for receiving at least two skis that comprise elongate flat beams the front of which are curved upwardly when the ski is in use, the skis being secured in spaced parallel relation to each other with the front tips of each ski curved toward the rear tip of the other ski. The carrier just described, for example, is ideally suited for carrying two or four skis and being received in the container. The container comprises a central section and first and second end sections so constructed as to be telescopically secured at the respective ends to the central section, the respective ends being curved at the distal ends to fit snugly over the respective curved front ends of the skis received therein. The central section and end sections define generally flat sides and a top and a bottom that, together define a main cavity portion. The top and the bottom are so formed and constructed as to define parallel elongate cavity portions extending longitudinally of the container and outwardly from the main cavity portion defined by said sections for receiving bindings secured to skis positioned in the main cavity portion the container.

In a preferred embodiment, a major central portion of the top and the bottom of the container lies in a plane and the end sections are so constructed and configured that the distal portion of at least one of the top or bottom extends centrally of the container away from the plane in which said top or bottom lies. In this latter form, the container may further comprise at least one wheel rotatably mounted in the distal portion of the top or bottom that extends centrally of the container away from the plane in which said top or bottom lies, the wheel being so mounted as to extend toward but not reach the plane in which the top or bottom lies. This configuration allows the user to pick up one end of the container and pull it with the wheel rolling on the floor but when the container lies flat, as in the cargo bay of an aircraft, the wheel does not touch the deck or supporting surface.

BRIEF DESCRIPTION OF THE DRAWINGS

FIG. 1 is a schematic depiction of a pair of skis S1 and S2 in a clamp of the type to which this invention is directed.

FIG. 2 is an isometric, partial cross-sectioned view of two pairs of skis, no bindings, secured in the clamp of this invention.

FIG. 3 is a vertical plan view, on one side, showing the construction of the clamp similar to that shown in FIG. 2, except that pressure plates are not included in the device of FIGS. 3 and 4.

FIG. 8 is an end view of the clamp showing the use of the ski binding heel plate "B" to clamp and secure the ski into the clamp of this invention.

FIG. 9 is an isometric view, in greatly reduced proportion, showing the overall outer configuration of a carrying case in which the skis and the clamp of this invention may be carried.

FIG. 10 is a cross-sectional view of the case depicted in FIG. 9 taken approximately at the center in the direction of the arrows along lines 10—10.

FIG. 11 depicts approximately one-half of an assembly of two skis in the carrying case showing the arrangement of the ski and clamp in the case with the ski blade surface bearing on the inner surface of the channel of the carrying case.

DESCRIPTION OF THE PREFERRED EMBODIMENTS

Figure 5:
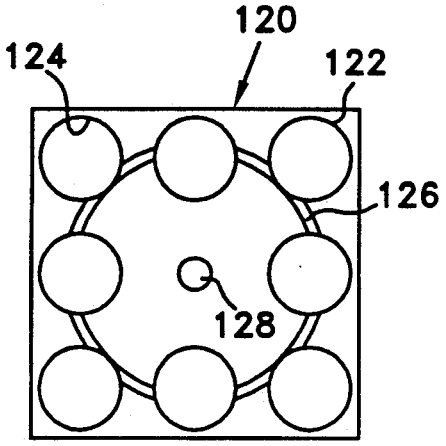
FIG. 5 is a top plan view of the mounting block for the clamp.

One principal object of the clamps of this invention, designated at in FIG. 1 as 100*a* and 100*b*, is to secure a pair of skis S1 and S2 together with the binding facing the other ski, with the tips at opposite ends, in a manner to assure that the skis will be protected and yet are easily carried. One pair of skis may be carried with the ski bindings mounted on the skis. The clamps 100 shown in FIG. 1 rely on the compression of one binding heel plate spring as shown in FIG. 8 one compression spring as shown FIG. 2 for its holding action.

As shown in FIG. 1, the clamps are normally used in pairs and clamp the skis at spaced locations along the length of the skis. The spacing is a function of the position of the bindings, where the ski binding heel plate is used. In a given clamp, the compression spring C counter opposes the heel plate spring acting on the second ski. The coaction of one ski binding heel plate in one clamp and spring in the second clamp maintains the principal length of the ski blades, which are generally linear, in a parallel position, as in FIG. 1, with the tips at opposite ends and held apart so as not to damage the other ski.

By removing the ski bindings, two pairs of skis may be carried, as shown in FIG. 2, for example. One of the clamps 100 is shown in FIG. 2 in which four skis S1, S2, S3 and S4 (typically but not necessarily comprising two pairs of skis) are clamped, the skis being shown in cross-section with the extended ends being removed for clarity of illustration of the clamp. In this configuration no ski bindings are present and two opposing compression springs attached to the center block, serve to space and hold the tandem ski blades apart. In the instance in which the ski bindings are removed, the clamps may be positioned at any convenient locations along the length of the skis.

It will be apparent that the clamps are normally used with either one or two springs depending on whether one pair or two pairs of skis are to be clamped therein.

The clamp 100 comprises a pair of leaf spring plates 102 and 104. The ends of each of the plates are rolled inwardly, as indicated at 106 and 108 for plate 102 and 110 and 112 for plate 104. It is the inward rolled portion which grips the skis in a manner to be described and as depicted in FIG. 2.

The plates or gripper members 102 and 104 are secured with the rolled portions facing inwardly toward each other in a spaced apart parallel relationship by a mounting block 120. The rolled ends accurately control the parallel spacing of the generally linear portion of the of the ski blades ensuring compatibility to the carrying case when used in conjunction with the ski clamps. Reference is made now to the mounting block 120 as depicted in FIG. 5 for a detailed description. The block is substantially square, although a rectangular block could be used and is, in the preferred embodiment formed of aluminum, for light weight. In a typical embodiment, the block is from two and one half to three inches square, nominally being about 2.75 inches square viewed from the top as in FIG. 5. The block may be of any desired thickness. It has been found, however, that blocks within the thickness range of approximately ¾ of an inch are satisfactory. The block 120 has drilled through it a number of holes, two of which are indicated at 122 and 124 simply to reduce the weight of the block. As such they are not necessary to the functioning of the clamp. The holes, and the exemplary embodiment, are drilled in sets of three proximity to the four sides of the block but any arrangement may be used.

A groove 126 is formed in the upper surface of the block, as shown in FIG. 5, to receive and secure the spring used for clamping the skis in the block. A corresponding groove is formed in the lower surface of the block. Drilled centrally in the block is a threaded aperture 128 for receiving and mounting the screws to hold the compression spring retaining plate 132, which is shown in detail in FIG. 7.

Returning to FIG. 2, the upper half of the clamp comprises a spring 130 which is secured into the groove 126 of the block 120 by a keeper 132 which in turn was secured in place by a screw 134.

Figure 7:
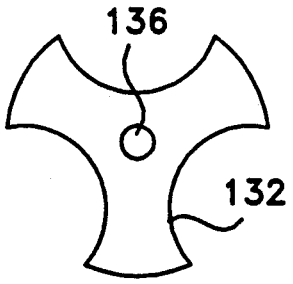
FIG. 7 is a top plan view of a spring clamp that is used to secure the spring to the block.
Figure 6:
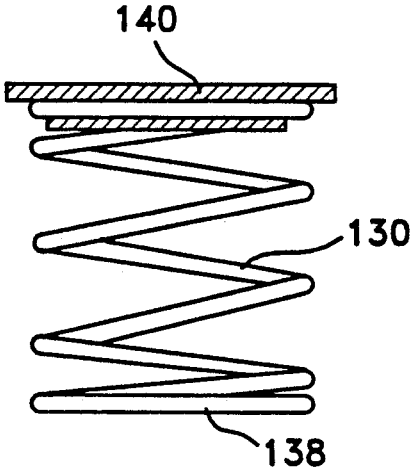
FIG. 6 is a side elevational view of the spring and pressure pad that is used in one form of the invention.

Reference is now made to FIGS. 6 and 7 wherein the spring 130 and the keeper 132 are shown in more detail. The keeper has an aperture 136 for receiving the screw 134 and securing the keeper to the block 120. The lower end of the spring 130 indicated at 138, is received in the groove 126 and is held there by the keeper 132 and keeper screw 134. Secured in the top of the spring, as shown in FIG. 6, is a pressure plate 140 to provide means for exerting pressure against the ski to keep it in the clamp without abrading or damaging the surface of the ski. The pressure plate 140 is snapped or screwed into the end of the spring or may be otherwise retained in the top of the spring. The spring may be inwardly tapered to permit the top of the spring to go into the lower part of the spring, but this is not necessary.

The bottom half of the clamp is, in the embodiment depicted in FIG. 2, a mirror-image of the clamp as just described. The spring 150 and the pressure plate 160 are identical to the previously described spring and pressure plate, and are held in place and function in the manner described previously with respect to spring 130, et. seq.

Reference is now made to FIGS. 2, 3 and 4 again for a description of other optional features of the clamp. It is desirable, when using the clamp for shipping skis inside a rigid or semi-rigid ski carrier, to provide some kind of resilient or protective buffer to prevent the skis from bouncing around in the container against the walls thereof. Thus, a pair of resilient buffer springs 170 and 172 are secured by means of rivets 174 and 176, or by other keeper means, to the block. Similar keepers are on the other side, as viewed in FIG. 2.

It is also desirable, sometimes, to carry the ski poles etc. in the same carrying case with the skis. One or more clips such as shown at 180 and 182 in FIG. 2 may be secured by rivets 184 and 186 respectively to the spring leaf 104 and, in like manner, to the spring leaf 102, the clips not being shown in FIG. 2. These pole clips are preferably coated with a soft, protective layer of polymer, e.g. polyvinyl chloride, polyethylene, polypropylene, etc. or can be formed of a resilient polymer, e.g. nylon, Delrin®, polycarbonate, etc. and can be mounted in slots, so as to traverse upward or downward as desired for alignment, they can also be rotated 360°. The ski poles whether straight or "S" shaped can now span between one ski blade clamp to the other ski blade clamp by engaging clips 180*a* to 180*b* or 182*a* to 182*b*, the relationship of the clips on two such clamps, 100*a* and 100*b*, being best shown in FIG. 1. The clips are standard articles of commerce and are only important to the invention in conjunction with the carrying case. In this event when the clips contain poles they virtually lock the ski blade clamps in position about the ski blades and prevent lateral movement of the clamps in the carrying case.

The operation of the clamp is extremely simple and very reliable. The two skis, S1 and S2 are, respectively, simply pushed into the respective top and bottom portions of the clip or clamp as described. The resilient sides 102 and 104 simply spread apart and allow the ski to enter and are then spread apart manually to remove the skis.

It is desirable to protect the skis along their edges from possible abrasion by the clip. To this end, a pair of polymeric sheets 190 and 192 are secured inside the sheet spring plates 102 and 104. In the embodiment depicted in FIG. 2, these polymeric sheets are secured along respective spring walls in pairs and are secured to the spring face at one end only by rivets, adhesive bonding, clamping between the spring plate and the block, or in any convenient way. The springs 102 and 104 are attached to the centre block 120 by rivets 198 and 199 utilizing the reduced wall thickness of the centre block lightening holes to effect attachment to the block.

Figure 4:
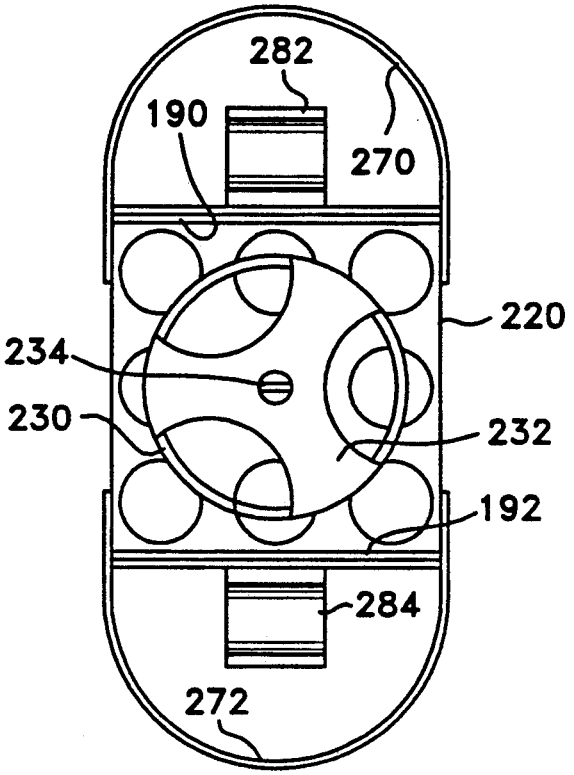
FIG. 4 is a top cross sectional view looking downward from the top of the clamp in the direction of the arrows along lines 4—4 as shown in FIG. 3.

The pressure plates are not included in FIG. 3 and FIG. 4 because it is possible to use the invention without these pressure plates and also for clarity of depiction of the structure. In all essential respects the clamp of FIGS. 3 and 4 is identical to the ski clamp of FIG. 2, however. It will, of course, be understood that details of connection components, etc. may vary without departing from the scope of the invention.

The resilient protective or buffering devices 270 and 272 are identical to 170 and 172, details of the fastening being omitted in FIG. 4. Likewise, the spring 230 is secured to the block 220 by a keeper 232 and a keeper screw 234 which are identical to comparable elements previously described.

A great many kinds of materials may be used to construct the clamp as described. Ordinary spring steel may be used and the entire device constructed of steel. Ordinary spring steel rusts and polymers deteriorate at very high temperatures and become brittle at very low temperatures. Stainless spring steel in combination with aluminum will not fail, deteriorate in strength or corrode. As previously discussed, the block 120, 220, is made of aluminum. This is simply for lightness and other materials could be used. A polymeric block may, however, be used. Polycarbonates, nylons, polyvinyl acetals, etc., and other polymers are quite suitable for this kind of use. Aluminum is chosen in the present instance, however, because it provides an optimum of strength and lightness. The leaf springs and all of the other metal components are preferably made of stainless steel, although they could be made of other materials including aluminum. Optimum resilience, strength, resistance to rust, and durability is found in using stainless steel, however, and it is the preferred material for these components. The polymeric protective sheets inside the springs may be made of polyethylene, polypropylene, nylon, or any other polymer. A self-lubricating polymer such as nylon, however, is preferred. All that is necessary is that the sheet be in place to prevent the skis from rubbing against the metal spring plates.

Likewise, the two buffer shock absorbing springs 170, 270 and 172, 272 are also made of stainless steel or tempered aluminum.

The invention generally requires the presence of one compression spring per clamp when bindings are present or two compression springs when bindings are absent. The invention depicted in FIG. 8 shows one compression spring depicted in FIGS. 8 and 11. In this instance, the bindings of the skis are used to clamp the ski inside the clamp in the same manner that the bindings apply pressure in clamping the skis to the ski boot. The spring loaded heel plate of the binding applies pressure to the block in the same manner it does when clamping the skis to the ski boot. The compression spring nominal rate in lbs is of sufficient load to counter balance the heel plate spring. Referring specifically to FIG. 8, the ski S1 having traditional and/or conventional binding B, is secured using the resilience of the bindings B to secure the ski in the clamp which comprises the leaf springs 202 and 204, the polymeric sheets 190 and 192, and the block 220. Because the skis and the bindings are conventional and are commonly very widely used, a detailed discussion of the skis and binding is considered unnecessary.

The clamp and the skis just described are conveniently carried in a box which is depicted in FIGS. 9 and 10. As shown in FIG. 9, the box 300 is an elongate box in the form of a parallelogram where two of the corner angles are acute and two obtuse, to accommodate for the ends of the skis, as depicted in FIG. 1, which extend outwardly and curve downwardly or upwardly respectively. The container may be formed in two or three, or more, sections, a center section 302 may, for example, have caps or end sections 304 and 306 into which the center section slides, or vice versa, the center section may slide over the end portion, the telescoping sections providing available range for long or short skis. In the embodiment depicted in FIG. 9, two hand holds 310 and 312 are provided, one at each of the respective ends, and serve as handles for handling, loading and moving the container. A carrying handle 330 may be provided in the center of the box, and may be within the channel, to permit of gravity pick-up of the carrying container.

FIG. 10 depicts a cross-sectional view of the container 300 and FIG. 11 shows the upper, approximately ½, of such a container with the ski clamped therein, as depicted in FIGS. 3, inside the container. Cross-sectionally, the container 300 forms an elongate chamber 320 in which the skis are received mounted in the clamping lock as just described. A pair of elongate channels are provided at the top and the bottom of the box, the channels at the top being depicted at 322 and 324 the channels at the bottom being depicted at 326 and 328. As depicted in FIG. 11 the ski binding anti-slip prongs can extend into these channels if not totally profiled by heel plate compression. As depicted in FIG. 11, the ski bindings extend into these channels and permit the convenient carrying of the skis. The resilient buffer springs or guide bands 170 and 172 ride against the interior surfaces of the container to prevent the skis from shaking loosely around the inside of the container.

It will be understood, of course, that the clamp may be used with the container as described, or the skis may be carried in any other container, bag, etc. The guide bands 170, 172 FIG. 2 can be conveniently removed from the clamp block when the ski clamps are not used in conjunction with the container described in FIG. 9.

One or more wheels 332, preferably spherical solid rubber wheels, removeably mounted by a removable shaft 334 journaled in the walls of the container may be attached to either or both of the curved handles 310 and 312 to provide portage of the lengthy container by the tote method. Removal of one or both spherical wheel allows withdraw of the other spherical wheel and shaft if toting is undesirable. An important feature of the wheel mounting is that the wheels do not contact the supporting surface when the container is placed flat on a flat surface, the wheel being mounted on the curved end handle portion 10 which curves or extends linearly upwardly from the bottom of the container, the wheel not extending outwardly enough to reach the level of the bottom of the container.

It will be understood that the foregoing description describes optimum and preferred embodiments of the invention as presently conceived and constructed, and the description is not limited beyond that essential to achieve the functions as described. The dimensions are not critical, except to the extent that the clamp must grip the skis, and the specific configurations are not critical beyond those configurations dictated by the function by the part or parts. Accordingly, the invention is not limited other than by the scope of the claims as appended hereto.

INDUSTRIAL APPLICATION

This invention is useful in the manufacture of ski accessories and the carrying and handling of skis.

What is claimed is:

1. A carrier for skis of the type that comprise an elongate flat beam structure forming upper and lower surfaces lying, respectively, in generally parallel planes, comprising a pair of generally planar spring plates each plate having first and second ends, ski retaining means secured at said first and second ends of said plates extending in the same direction from the plane of the respective plate, and spacer means secured generally centrally to the plates mounting the spring plates in spaced parallel relationship with the respective ski retaining means extending toward each other from the respective spring plates; the plates, spacer means and retaining means being so dimensioned and configured as to permit a first ski to be retained snugly between the respective first ends of the plates and a second ski to be retained snugly between the respective second ends of the plates with the plane of surfaces of the skis lying generally perpendicularly to the planes of the plates and to permit the skis to be inserted into such retained position and removed therefrom by spreading the respective ends of the plates apart against resilient retaining forces exerted by the plates.

2. The ski carrier of claim 1 further comprising polymeric protective sheets on the facing surfaces of the spring plates for preventing abrasion of the skis by the spring plates.

3. The ski carrier of claim 2 further comprising means resiliently forcing the first and second skis, respectively, against the respective retaining means at the respective first and second ends of the plates.

4. The ski carrier of claim 3 wherein the retaining means comprise inwardly rolled portions of the material of which the spring plates are formed.

5. The ski carrier of claim 4 wherein the means resiliently forcing the skis comprises a coil spring secured to the spacer means and extending between and toward the respective ends of the of the plates.

6. The ski carrier of claim 5 wherein the means resiliently forcing the skis further comprises pressure pads secured at the distal ends of the coil springs for exerting a resilient pressure on the respective skis without abrading the skis.

7. The ski carrier of claim 6 wherein the spacer means defines a generally circular recess that receives the proximal end of said spring in said recess.

8. The ski carrier of claim 7 further comprising resilient shock absorbing means extending outwardly from the spacer block on both sides thereof substantially perpendicular to the planes of the respective plates.

9. The ski carrier of claim 8 wherein the resilient shock absorbing means comprises a pair of resilient bands and means securing the respective ends of the respective bands to the spacer means.

10. The ski carrier of claim 1 further comprising means resiliently forcing the first and second skis, respectively, against the respective retaining means at the respective first and second ends of the plates.

11. The ski carrier of claim 10 wherein the means resiliently forcing the skis comprises a coil spring secured to the spacer means and extending between and toward the respective ends of the plates.

12. The ski carrier of claim 11 wherein the means resiliently forcing the skis further comprises pressure pads secured at the distal ends of the coil springs for exerting a resilient pressure on the respective skis without abrading the skis.

13. The ski carrier of claim 1 wherein the retaining means comprise inwardly rolled portions of the material of which the spring plates are formed.

14. The ski carrier of claim 13 further comprising polymeric protective sheets on the facing surfaces of the spring plates for preventing abrasion of the skis by the spring plates.

15. The ski carrier of claim 13 further comprising at least one clip for resiliently securing a ski pole to the carrier.

16. A ski carrier comprising a pair of generally planar spring plates each plate having first and second ends, ski retainers formed at the respective ends of the respective plates from the material of which the plates are formed extending in the same direction from the plane of the respective plate, a spacer block, means securing the spacer block generally centrally to the plates mounting the spring plates in spaced parallel relationship with the respective ski retainers extending toward each other from the respective spring plates, the plates, spacer and retainers being so dimensioned and configured as to permit a first ski to be retained snugly between the respective first ends of the plates and a second ski to be retained snugly between the respective second ends of the plates with the surfaces of the skis generally perpendicularly to the planes of the plates and to permit the skis to be inserted into such retained position and removed therefrom by spreading the respective ends of the plates apart against resilient retaining forces exerted by the plates.

17. A ski carrier comprising a pair of generally planar resilient plates secured in spaced apart parallel planar relationship to receive therebetween a pair of skis with the plane surfaces of the skis lying substantially perpendicular to the planes in which the plates lie, the plates having first and second ends, retainers on the first ends of the respective plates extending toward each other, retainers on the second ends extending toward each other, the plates and retainers being so configured and constructed as to accept between the plates adjacent the retainers a first ski between the first ends and a second ski between the second ends.

18. The ski carrier of claim 17 further comprising means for resiliently securing the respective skis between the plates and against the retainers at the respective ends of the plates.

19. The ski carrier of claim 18 further comprising at least one clip secured to the plates for gripping a ski pole to the outside of the ski carrier.

20. The ski carrier of claim 19 further comprising polymeric protective sheets on the facing surfaces of the spring plates for preventing abrasion of the skis by the spring plates.

21. The ski carrier of claim 18 further comprising polymeric protective sheets on the facing surfaces of the spring plates for preventing abrasion of the skis by the spring plates.

22. A ski container for receiving at least two skis that comprise elongate flat beams the front of which are curved upwardly when the ski is in use, the skis being secured in spaced parallel relation to each other with the front tips of each ski curved toward the rear tip of the other ski, the container comprising:

a central section and first and second end sections so constructed as to be telescopically secured at the respective ends to the central section, the respective ends being curved at the distal ends to fit snugly over the respective curved front ends of the skis received therein, the central section and end sections defining generally flat sides and a top and a bottom that, together define a main cavity portion, the top and the bottom being so formed and constructed as to define parallel elongate cavity portions extending longitudinally of the container and outwardly from the main cavity portion defined by said sections for receiving bindings secured to skis positioned in the main cavity portion of the container.

23. The container of claim 22 wherein a major central portion of the top and the bottom of the container lies in a plane and wherein the end sections are so constructed and configured that the distal portion of at least one of the top or bottom extends centrally of the container away from the plane in which said top or bottom lies.

24. The container of claim 23 further comprising at least one wheel rotatably mounted in the distal portion of the top or bottom that extends centrally of the container away from the plane in which said top or bottom lies, the wheel being so mounted as to extend toward but not reach the plane in which the top or bottom lies.

* * * * *